United States Patent [19]

Thomson et al.

[11] Patent Number: 4,943,035

[45] Date of Patent: Jul. 24, 1990

[54] BARRICADE

[75] Inventors: Kenneth L. Thomson, Huntington Beach, Calif.; Hank Fenton, Charlie Lake; Norbert Tesch, Coquitlam, both of Canada

[73] Assignee: Amplas, Inc., Huntington Beach, Calif.

[21] Appl. No.: 297,101

[22] Filed: Jan. 13, 1989

[30] Foreign Application Priority Data

Jan. 14, 1988 [DE] Fed. Rep. of Germany ... 8800324[U]

[51] Int. Cl.[5] ..... E04H 17/14

[52] U.S. Cl. ..... 256/64; 256/1; 256/19; 404/6; 116/DIG. 16

[58] Field of Search ..... 256/1, 19, 64–66, 256/59; 116/63 R, 63 P, DIG. 16; 182/183, 186, 46, 226; 404/6, 9

[56] References Cited

U.S. PATENT DOCUMENTS

| | | | |
|---|---|---|---|
| D. 277,785 | 2/1985 | Green | D24/27 |
| 1,014,554 | 1/1912 | Zent | 256/64 X |
| 2,793,003 | 5/1956 | Borchers | 256/64 |
| 2,803,502 | 8/1956 | Ellinger | 304/5 |
| 2,930,589 | 3/1960 | Blaskiewicz | 182/183 |
| 3,349,869 | 10/1967 | Evans | 182/226 |
| 3,837,626 | 9/1974 | Dixon | 256/64 |
| 4,030,565 | 6/1977 | Chaput | 182/151 |
| 4,298,186 | 11/1981 | Glass | 256/64 |
| 4,516,109 | 5/1985 | Thurston | 116/63 R |

FOREIGN PATENT DOCUMENTS

| | | | |
|---|---|---|---|
| 471322 | 7/1914 | France | 304/5 |
| 7313921 | 4/1974 | Netherlands | 256/19 |
| 428827 | 7/1967 | Switzerland | 256/64 |

*Primary Examiner*—Andrew V. Kundrat
*Assistant Examiner*—Franco S. DeLiguori
*Attorney, Agent, or Firm*—Christie, Parker & Hale

[57] ABSTRACT

A barricade is provided for use at construction sites, on roadways and highways, and the like, or for crowd control, for example, at the scene of an emergency. The barricade includes an elongated, hollow crossbar member that comprises one or more elongated, hollow interconnecting sections, with each end of the crossbar member mounted in a collapsible A-frame support. The barricade can be collapsed from its fully-assembled, in-use configuration into a compact unit or package which takes up relatively little space so that it can be conveniently transported from place to place.

9 Claims, 7 Drawing Sheets

BARRICADE

FIELD OF THE INVENTION

The present invention relates to barricades of the type useful at construction sites, on roadways and highways, and the like, or for crowd control, for example, at the scene of an emergency. More particularly, the invention relates to a unique barricade that is lightweight and that can be disassembled, with its parts configured to be formed into a compact unit or package that can be conveniently stored and transported from place to place.

BACKGROUND OF THE INVENTION

Barricades are used, inter alia, to block entry to streets and highways, for crowd control during emergencies, and at construction sites. Such barricades can be provided in various shapes and forms. One commonly-used barricade is constructed of a wooden crossbar member having a standard length, usually six to ten feet, supported on its ends by A-frames constructed of wood or plastic. This commonly-used barricade is relatively heavy and takes up a relatively large amount of space, even when disassembled, because the A-frames are not capable of folding, and the wooden crossbar member has the aforementioned length. Furthermore, when such a barricade is struck by a vehicle, both the vehicle and the barricade are likely to be damaged.

It is desired, therefore, to provide to the art a barricade that is lightweight, which can be taken apart from its in-use condition and reassembled into a compact unit for convenient storage and transportation, and which, when struck by a vehicle, is less likely to damage the vehicle or to be damaged itself than are commonly-used barricades.

SUMMARY OF THE INVENTION

The present invention is directed to a barricade of the type useful at construction sites, on roadways and highways, and the like, or for crowd control at the scene of an emergency. The barricade comprises an elongated, hollow crossbar member comprising at least one elongated, interconnecting hollow section formed from plastic by a molding process. Each such section has first and second elongated sides, first and second edges connecting the sides, and a generally rectangular cross-section transverse to its length. One end of each such section has at least one male extension, and its opposite end has at least one female receptacle for receiving and securing the male extension of a mating section. There is at least one indentation in one of the elongated sides formed during the molding process. Such an indentation extends to the opposite elongated side, such that the interior surface of the indentation is fused to the interior surface of the opposite elongated side. A collapsible A-frame support is provided for each end of the elongated, hollow crossbar member. Each such A-frame support comprises a pair of hollow legs, with each leg having a bottom end for contact with the ground surface, and a top end configured to engage the top of the opposite leg. The legs are pivotally connected below their top ends so that when the legs are fully opened, their top ends are engaged and define an opening that is configured to receive one end of the elongated, hollow crossbar member.

The barricade can be collapsed from its fully-assembled, in-use configuration into a compact unit or package which takes up relatively little space so that it can be conveniently transported from place to place. The barricade package comprises a plurality of crossbar sections stacked one on top of the other on their elongated sides. There are grooves through the first and second edges of each such crossbar section, the grooves being configured to line up with each other so that when the sections are stacked one on top of the other, the grooves in the edges are lined up with each other. The stacked-together crossbar sections are sandwiched between one A-frame support positioned under the crossbar section stack and the other A-frame support positioned on top of the crossbar section stack. The legs of the stacked A-frame supports are in their closed condition extending along the length of the crossbar sections. Each such leg includes a slot through it which registers with the lined-up grooves in the crossbar section edges. A U-shaped locking bracket is provided, with the base of the bracket extending below the A-frame support under the stack. The sides of the bracket extend through the slots in the legs of the bottom A-frame support, through the lined-up crossbar section grooves, and through the slots in the legs of the A-frame support on top of the stack so that the tops of the bracket sides extend above the top A-frame support. Means are provided for latching together the top portions of the bracket sides so that the A-frame supports and crossbar sections are fastened together securely into a compact unit for transportation and storage.

BRIEF DESCRIPTION OF THE DRAWINGS

These and other features, aspects, and advantages of the present invention will be more fully understood when considered with respect to the following detailed description, appended claims, and accompanying drawings, wherein:

DETAILED DESCRIPTION

Figure 1:
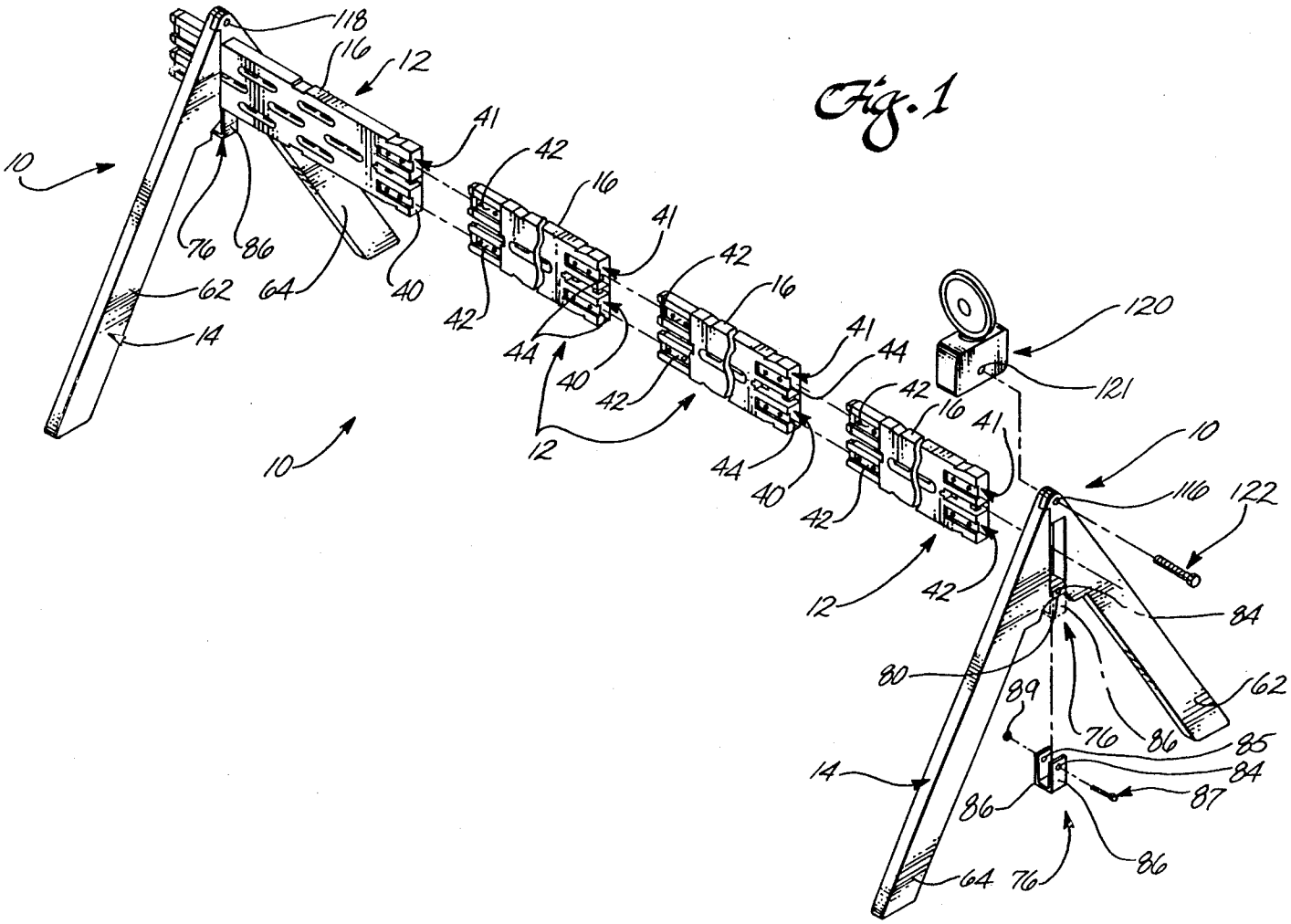
FIG. 1 is a semi-schematic, partially-exploded perspective view of one embodiment of a barricade provided in accordance with practice of principles of this invention.
Figure 2:
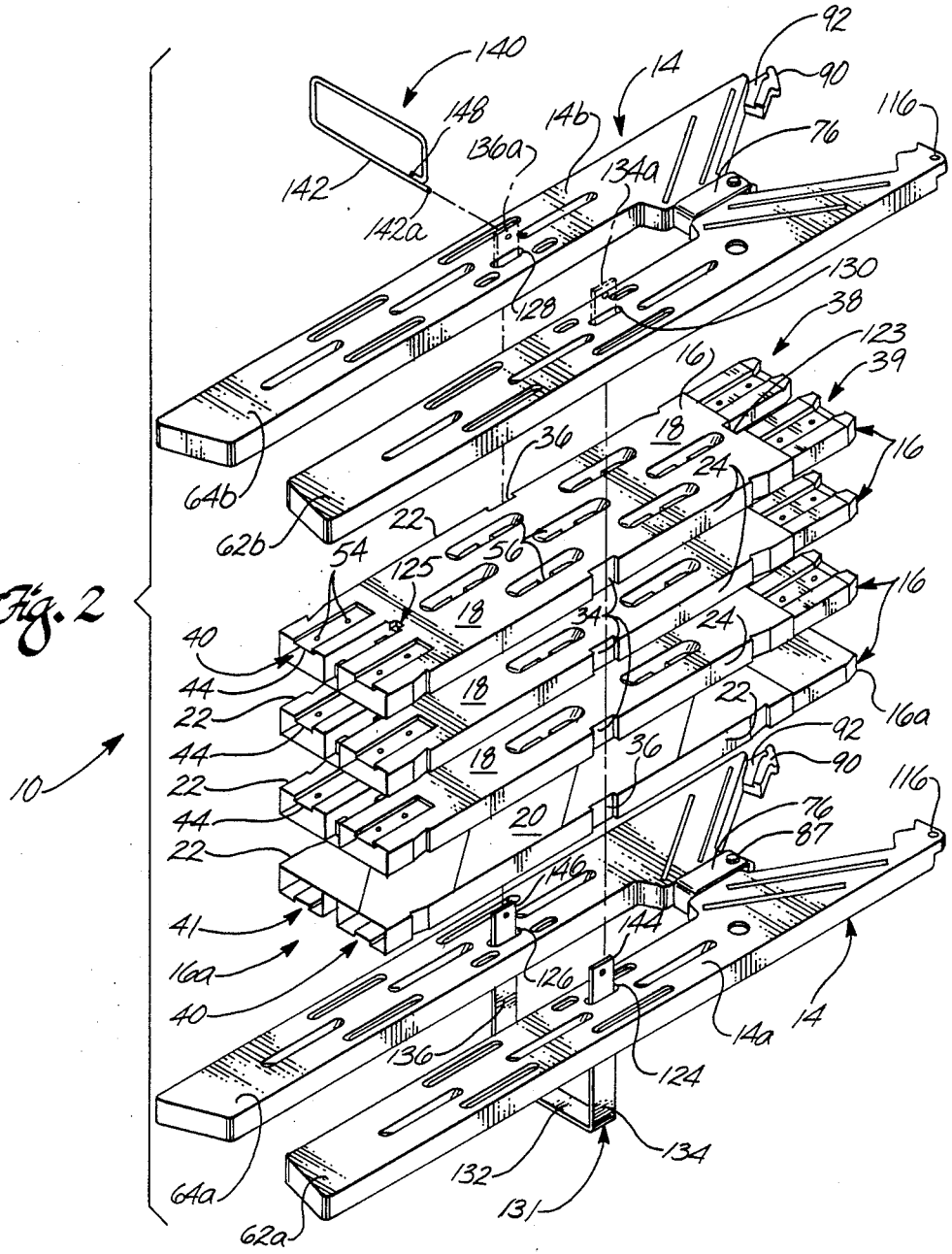
FIG. 2 is a semi-schematic, partially-exploded perspective view of the barricade of FIG. 1 shown in its disassembled configuration.
Figure 3:
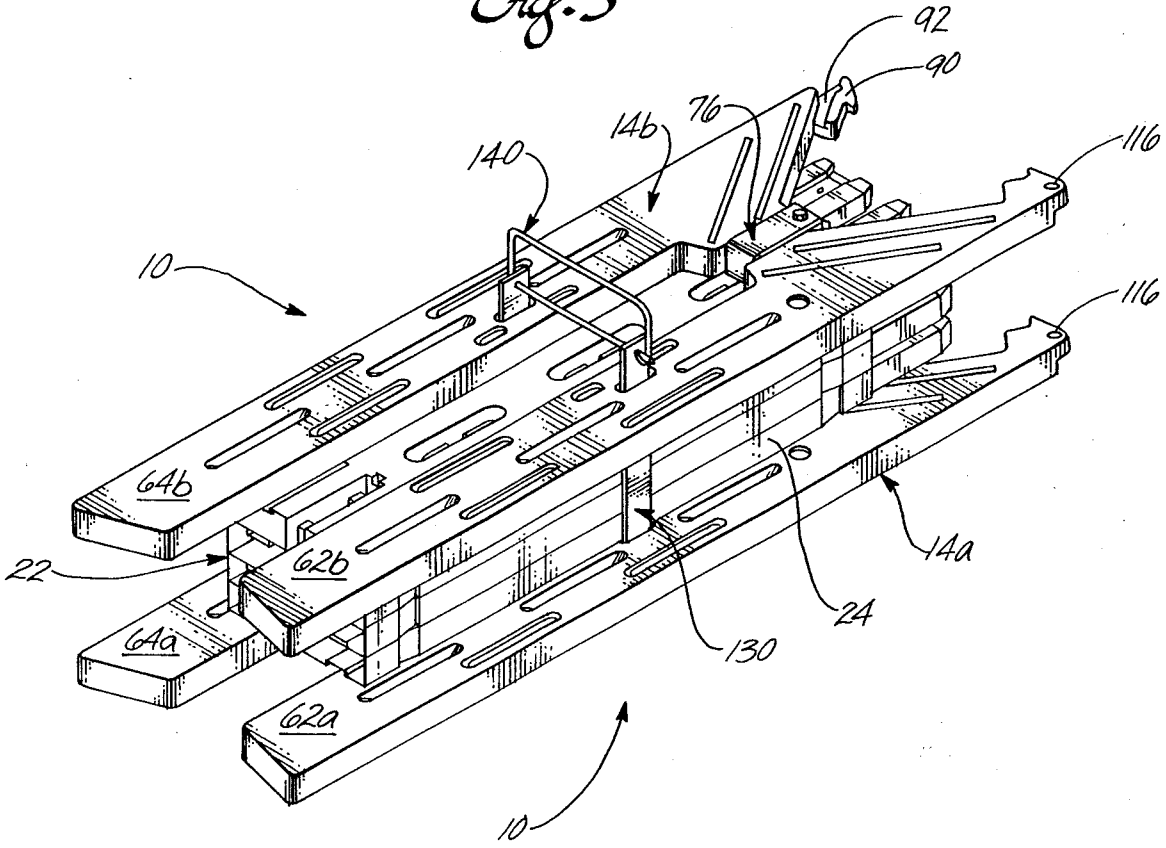
FIG. 3 is a semi-schematic perspective view of the barricade of FIG. 1 shown in its disassembled configuration with its components formed into a compact unit or package.

Turning to the figures, wherein like structural components are identified by like reference numerals, and referring particularly to FIG. 1, there is shown a preferred embodiment of a barricade 10 provided in accordance with practice of principles of the present invention. The barricade 10 is shown in its fully-erected condition ready for use at a construction site, on a roadway or highway, or for crowd control, for example, at the scene of an emergency. The barricade includes an elongated, hollow crossbar member 12, with the ends of the crossbar member mounted in a pair of collapsible A-frame supports 14. In FIGS. 2 and 3, which are described below in greater detail, the barricade 10 is shown in its disassembled condition with its components formed into a compact unit or package that can be conveniently stored and transported from place to place.

Figure 4:
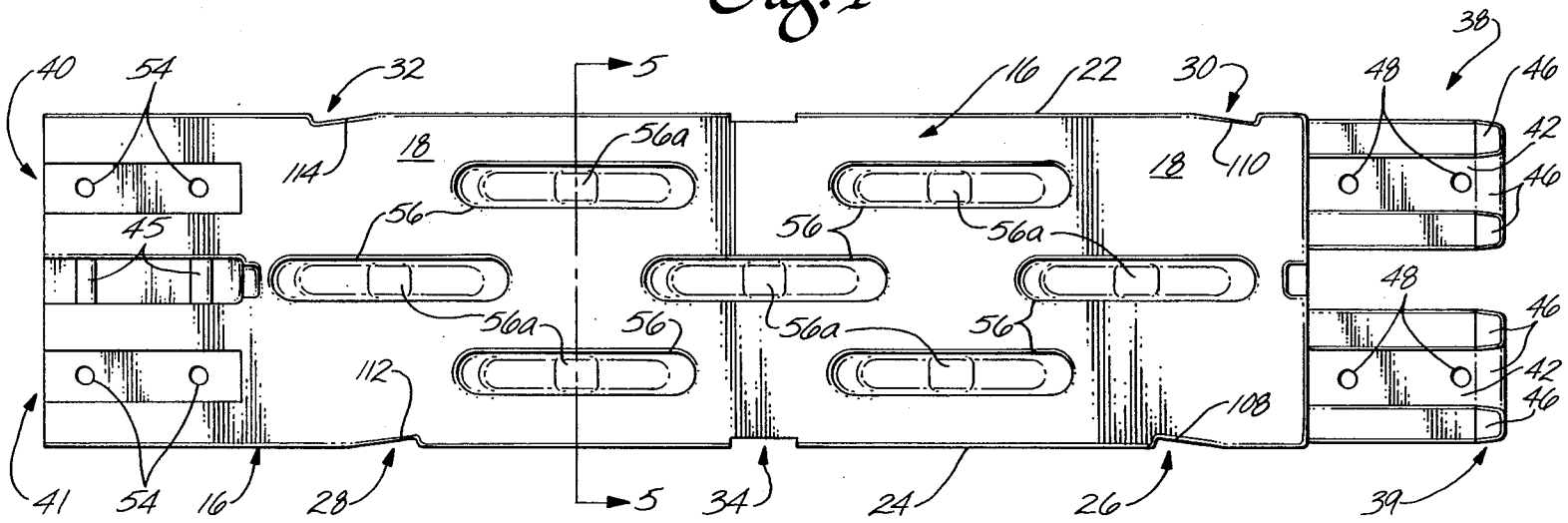
FIG. 4 is a semi-schematic side elevation view of one embodiment of a hollow crossbar section provided in accordance with this invention configured to interconnect with other such sections to form the hollow crossbar member component of the barricade.
Figure 5:
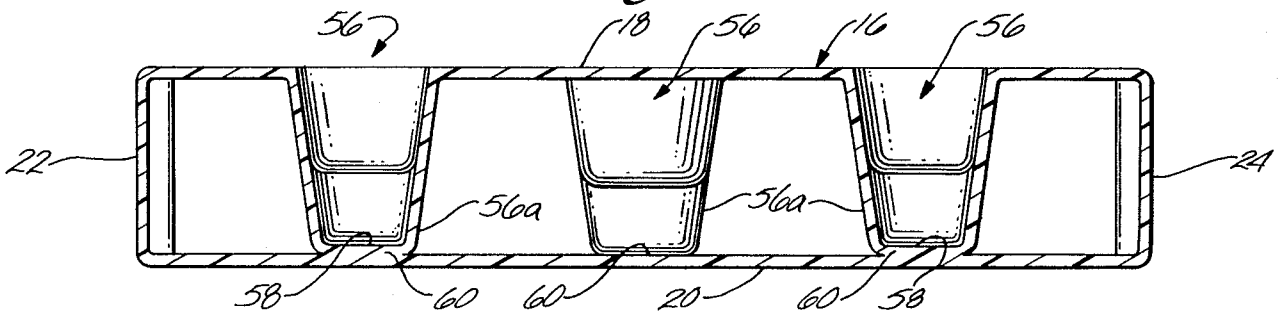
FIG. 5 is a semi-schematic cross-sectional view taken on lines 5—5 of FIG. 4.

Turning to FIGS. 4 and 5, in addition to FIGS. 1-3, each hollow crossbar member 12 comprises one or more elongated, interconnecting, hollow sections 16 formed from plastic by means of a conventional blow-molding process. Various plastics can be used, such as polyethylene, impact polystyrene, and the like. Each hollow crossbar section 16 has first and second elongated sides 18 and 20, respectively, with first and second edges 22 and 24 connecting the sides. A pair of tapered grooves 26 and 28 are spaced apart from each other in the edge 24, and a pair of tapered grooves 30 and 32 are spaced apart from each other in the edge 22. The tapered groove 26 is directly across the section 16 from the tapered groove 30, and the tapered groove 28 is directly across the section 16 from the tapered groove 32. Additionally, a rectangular groove 34 is in the edge 24 between the grooves 26 and 28, and a rectangular groove 36 is in the edge 22 across from the groove 34. As is described below in greater detail, the tapered grooves 26, 28, 30, and 32 are provided for mating with a surface in the A-frame support when the barricade is being erected. The rectangular grooves 34 and 36 are provided to act in conjunction with a locking bracket for securing the crossbar sections 16 between the A-frames 14 when the device is disassembled and its components arranged into its transportable package configuration, as shown in FIGS. 2 and 3.

A pair of spaced-apart male extensions 38 and 39 extend from one end of each such crossbar member section 16 along its length, and a pair of spaced-apart female receptacles 40 and 41 (best seen in FIGS. 1 and 2) are on the opposite end of each crossbar section 16 for receiving and securing the male extensions 38 and 39 of a mating crossbar section 16. In the illustrated embodiment, each of the male extensions 38 and 39 have a groove 42 in one side configured to mate with an elongated slide 44 (best seen in FIGS. 1 and 2) which extends into and along the length of each such mating female receptacle 40 and 41. The side of each male extension opposite from the side incorporating the groove is flat. Each extension 38 and 39 includes a taper 46 on its end, around its perimeter, which enhances the ease of insertion of the extensions into the female receptacles 40 and 41. Braces 45 are formed in the molded section 16 spaced apart from each other between the female receptacles 40 and 41 to provide rigidity. A pair of hemispherical indentations 48 are spaced apart from each other along the length of each of the grooves 42, and a pair of matching hemispherical indentations 50 (shown in FIG. 7) are spaced apart from each other in the surface 52 of each of the male extensions 38 and 39 opposite from the sides incorporating the grooves 42. The hemispherical indentations 48 engage hemispherical detents or bumps 54 which are spaced apart from each other and extend into each of the female receptacles 40 and 41 from the internal surface of the slide 44 of each such receptacle. The hemispherical indentations 50 in the surface 52 of each such male extension engage hemispherical detents or bumps (not shown) which extend into the female receptacles from the side of the receptacle opposite from the slide. Provision of the indentations in the male extensions which engage detents in the female receptacles facilitates securing the crossbar sections 16 together to form the crossbar member 12.

At least one indentation 56, which, in the illustrated embodiment, is elongated with its longitudinal axis along the length of the section 16, is formed in one of the elongated sides of each such crossbar member section 16 during the blow-molding operation. In the exemplary embodiment shown in FIG. 4, there are seven such indentations 56 along the length of the first elongated side 18 of each such crossbar section 16. A plurality of such indentations 56, and, in an exemplary embodiment, all seven indentations 56, have a portion 56*a* which extends to the opposite elongated side 20 of the crossbar section 16, so that the interior surface 58 of the plastic material that forms each such portion 56*a* of the indentation is fused to the interior surface 60 of the opposite elongated side 20 of the section 16. Although seven indentations 56 are shown in FIG. 4, each of which has a somewhat rectangular shape, rounded on the ends, more or fewer such indentations can be provided, and the indentations can have a different shape, if desired. The fused portions 56*a* of the indentations join together the first and second surfaces 18 and 20 of the hollow crossbar sections 16, thereby increasing the rigidity and the stiffness of the sections so that they maintain their shape during use, even under extreme temperature conditions.

Figure 6:
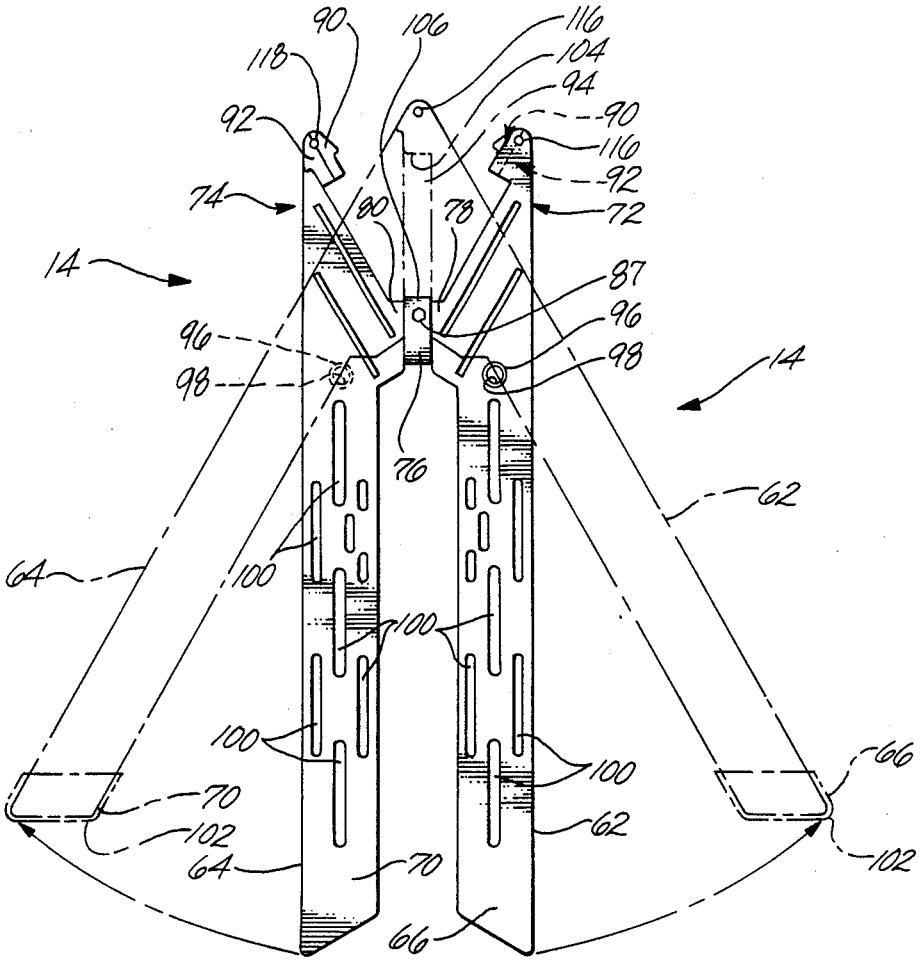
FIG. 6 is an end elevation view of one embodiment of an A-frame support provided in accordance with practice of this invention comprising a pair of legs, with the legs shown in both their fully-opened and fully-closed positions.
Figure 7:
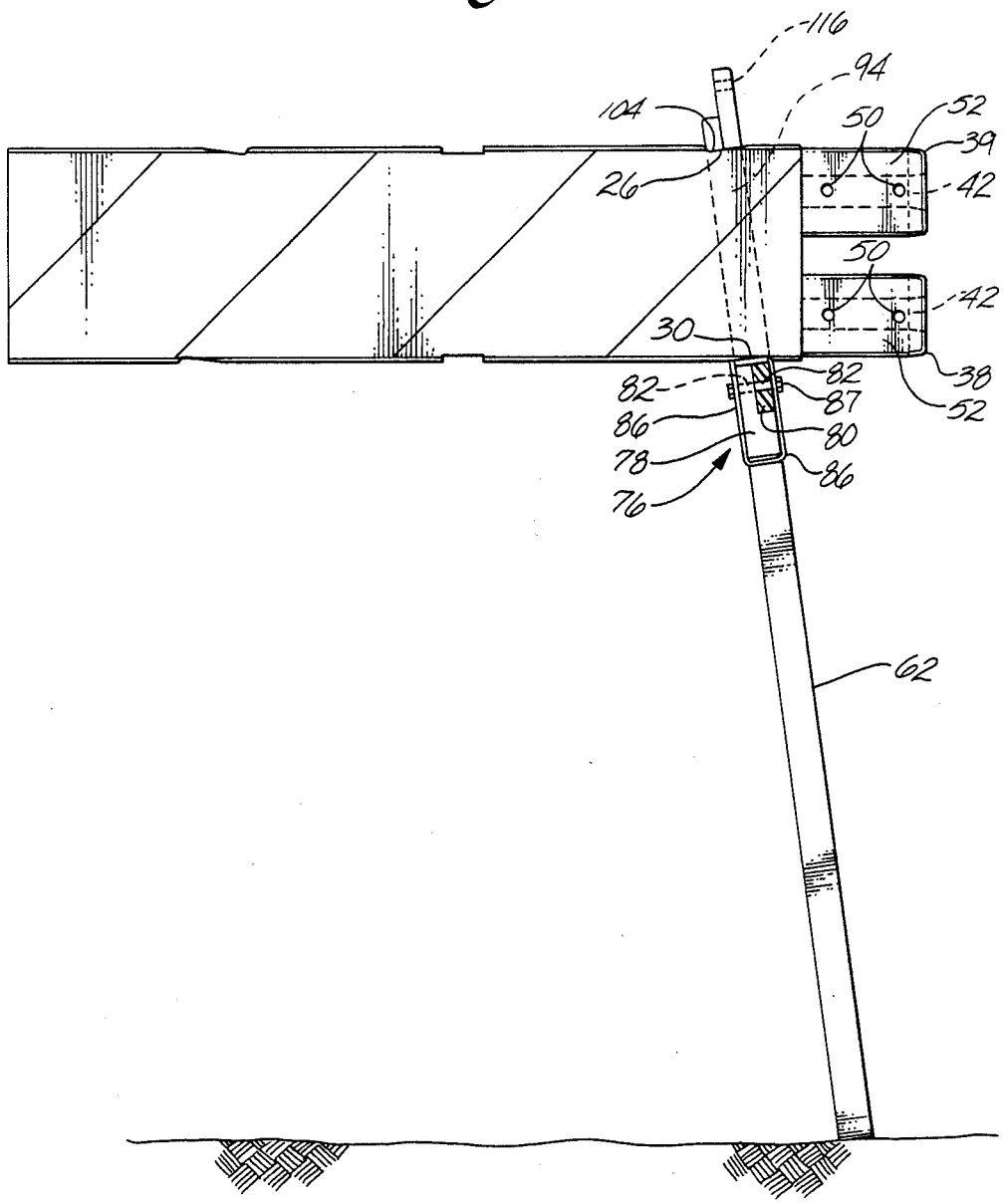
FIG. 7 is a side elevation, fragmentary view of one embodiment of a barricade provided in accordance with this invention showing one leg of an A-frame member provided in accordance with this invention mounting one end of a hollow crossbar member.

Turning now to FIG. 6, in addition to FIG. 1, the A-frame support 14 is shown both in its open condition (phantom lines), ready for use in the field, and in its closed condition (solid lines), ready to be assembled into the compact unit or package shown in FIGS. 2 and 3. Each such A-frame support 14 includes a pair of hollow legs 62 and 64. Each of the legs 62 and 64 has a bottom end 66 and 70, respectively, for contact with the ground surface, and a top end 72 and 74, respectively, which are configured to engage each other when the barricade is erected. The legs 62 and 64 are pivotally connected below their top ends 72 and 74 by means of a U-shaped bracket 76 which spans flanges 78 and 80 on the legs 62 and 64, respectively, and which face each other in overlapping arrangement. In one embodiment, the flanges 78 and 80 are about one-fourth of the distance from the top to the bottom of the legs. Turning to FIG. 7 in addition to FIGS. 1 and 6, each of the flanges 78 and 80 has a hole 82 formed through it (shown in FIG. 7 in dashed lines where the entire leg 62 and only the flange portion of the leg 64 is shown) so that the holes 82 are lined up with each other and are in registration with holes 84 and 85 through the opposed legs 86 of the bracket 76 (shown best in FIG. 1). The legs are pivoted on a bolt 87 which extends through the holes 84 and 85 in the legs 86 of the bracket 76, through the registered holes 82 in the overlapping flanges 78 and 80, and which is secured on its end by a nut 89.

Each such A-frame leg 62 and 64 includes a tang 90 and notch 92 in its top (best seen in FIG. 6), with the tang 90 and the notch 92 of the leg 62 facing in one direction, and the tang 90 and the notch 92 on the leg 64 facing in the opposite direction. When the legs are fully extended, as is shown in phantom on FIG. 6, the tang 90 of each such leg engages the notch 92 of the other leg, thereby locking the tops of the legs together with the legs in their fully-open position. Thus, when the legs are fully open, their top ends 72 and 74 are engaged by means of the tang-and-notch arrangement and define a rectangular opening 94 that is configured to receive one end of the elongated, hollow crossbar member 12.

As is shown in FIG. 6, in a preferred embodiment, each of the legs 62 and 64 of the A-frame 14 is open into its hollow interior by means of a hole 96 in one of its sides. The openings 96 are closed by means of plugs 98. A fluid, such as water, can be introduced into the hollow A-frame legs when the plugs 98 are removed from the openings 96 to thereby increase the weight of the barricade when in use, if desired. When the barricade is taken out of use and prior to arranging its components into the compact package configuration shown in FIGS. 2 and 3, the water can be poured from the legs, if desired. By providing an A-frame construction having hollow legs with openings for entrance and egress of fluids, such as water, the barricade's weight can be increased after it has been put together in the field. The extra weight inhibits the barricade from being toppled or pushed out of position by heavy winds or by crowds, or the like. Conversely, the barricade can be emptied to decrease its weight when not in use, thereby making it convenient to carry and transport from place to place.

A plurality of indentations 100 (shown in solid lines in FIG. 6) of varying shapes and sizes, similar to the elongated indentations 56 described above with regard to the crossbar sections 16, are preferably formed during the molding process in the legs 62 and 64 of the A-frame 14. In one preferred embodiment, opposed indentations are in both surfaces of the legs (only one set of such indentations is shown in FIG. 6), with the interior surfaces of at least some of the opposed indentations fused together to enhance the stiffness and rigidity of the legs.

If desired, flexible leg caps 102 made of a rubber or an elastomeric plastic, or the like (shown schematically in phantom lines in FIG. 6), that are configured to fit onto the bottom ends of the legs 62 and 64 are provided to inhibit the legs from slipping along the ground surface.

Turning to FIGS. 4, 6, and 7, the details of the fit between the crossbar member sections 16 and the A-frame supports 14 can be understood. As was described above with reference to FIG. 6, when the legs 62 and 64 of the A-frame support 14 are in their fully-open position, a rectangular opening 94 is provided in the support to receive and mount one end of the crossbar member section. The top surface 104 of the rectangular opening 94 is configured to engage one of any one of the tapered slots 26, 28, 30, or 32 in the first or second edges of the crossbar member section. The bottom surface 106 of the rectangular slot 94, which, in the illustrated embodiment, is defined by the top edges of the opposed legs 86 of the U-shaped bracket 76, is configured to engage one of any one of the slots 26, 28, 30, or 32. As is best seen in FIG. 4, the tapered surfaces 108 and 110 of the slots 26 and 30, respectively, are parallel to each other, as are the surfaces 112 and 114 of the respective slots 28 and 32. By providing the four tapered slots 26, 28, 30, and 32 in each crossbar section 16, barricades which include crossbar members 12 made up of any number of crossbar sections 16, i.e., from a single section up to six or more sections, can be provided in accordance with practice of principles of the present invention. Furthermore, as is best seen in FIG. 7, the tapered slots are configured so that when the crossbar is mounted in the rectangular opening in the A-frame, the A-frame is tilted at an appropriate angle with the crossbar so that the barricade is stable.

Turning again to FIGS. 1 and 6, a circular opening 116 is through the top of the leg 62, and a circular opening 118 is through the top of the leg 64. As is seen in phantom in FIG. 6, when the legs are in their fully-extended position with the tang 90 of each of the legs engaging the notch 92 of the other leg, thereby locking the tops of the legs together, the opening 116 in the leg 62 is registered with the opening 118 in the leg 64. When the openings are in registration, a flashing light, such as the light 120 shown in FIG. 1, can be mounted onto the A-frame support, for example, by means of a threaded bolt 122, which extends through the registered openings 116 and 118 into an opening 121 in the casing of the light 120, and which is threaded to engage the threads in the bolt 122.

Turning now to FIGS. 2 and 3, the barricade device 10 provided in accordance with practice of this invention is shown after it has been removed from the field and disassembled, with its components secured together to provide a compact unit or package that can be conveniently stored and transported from place to place. In the illustrated embodiment, there are four crossbar sections 16 stacked one on top of the other on their elongated sides and sandwiched between a first A-frame support designated **14*a* on the bottom of the stack and a second A-frame support designated 14*b* on the top of the stack. The legs 62*a*, 64*a*, 62*b*, and 64*b* of the stacked A-frame supports 14*a* and 14*b*, respectively, are in their closed configuration and extend along the length of the crossbar sections 16. In a preferred embodiment, a slot 123 is in the surface 18 of each section 16 between the male extensions 38 and 39, and a slot 125 is in the surface 18 of the end of the section 16 between the female receptacles 40 and 41. The slots are configured to accommodate the nut 89 or the head of the bolt 87 which is through the bracket 76 to enhance the ease of stacking the sections 16 between the A-frame supports. Preferably, the side 18 of the crossbar section 16*a* in the bottom of the stack faces the bottom A-frame support 14*a* so that the head of the bolt 87 is in the slot 123 in the surface 18. The legs 62*a* and 64*a* of the A-frame support 14*a* have slots 124 and 126 through them, respectively. The legs 62*b* and 64*b* of the A-frame support 14*b* have slots 128 and 130 through them, respectively. When the crossbar sections 16 are stacked one on top of the other on their elongated sides, the grooves 34 in the edges 22 are lined up with each other, and the grooves 36 in the edges 22 are also lined up with each other. Because the bottom crossbar section 16*a* is facing the opposite direction from the other sections 16, the slot 36 of the section 16*a* is lined up with the slots 34 of the other sections, and the slot 34 of the section 16*a* is lined up with the slots 36 of the other sections. The slots 124, 126, 128, and 130 are lined up with the grooves 34 and 36 in the edges of the sections 16**.

A U-shaped locking bracket 131, which comprises a base 132 and two sides 134 and 136, is provided to secure the crossbar sections 16 between the A-frames 14a and 14b. The bracket sides 134 and 136 extend through the slots 124 and 126, respectively, in the legs 62a and 64a of the bottom A-frame support 14a, through the lined-up grooves 34 and 36 in the edges 24 and 22, respectively, of the support sections 16, and through the slots 128 and 130, respectively, in the legs 62b and 64b of the A-frame support 14b on the top of the stack. The top portions 134a and 136a of the bracket sides extend above the top A-frame support 14b.

Means are provided for latching together the top portions 134a and 136a of the bracket sides so that the A-frame supports and crossbar sections are fastened together securely for transportation and storage. In the illustrated embodiment, the latching means include a rod formed into a rectangular loop 140 that includes a bottom portion 142, which is configured to extend through holes 144 and 146 in the top portions 134a and 136a, respectively, of the U-bracket sides. When the rod portion 142 is through the holes 144 and 146, the free end 142a of the portion 142 is positioned in a hook 148 formed in the end of the loop 140 opposite the free end 142a, to thereby secure the barricade package together. The loop 140 is secured in the U-bracket 131 and acts as a handle by which the package can be easily lifted and transported from place to place.

Figure 8:
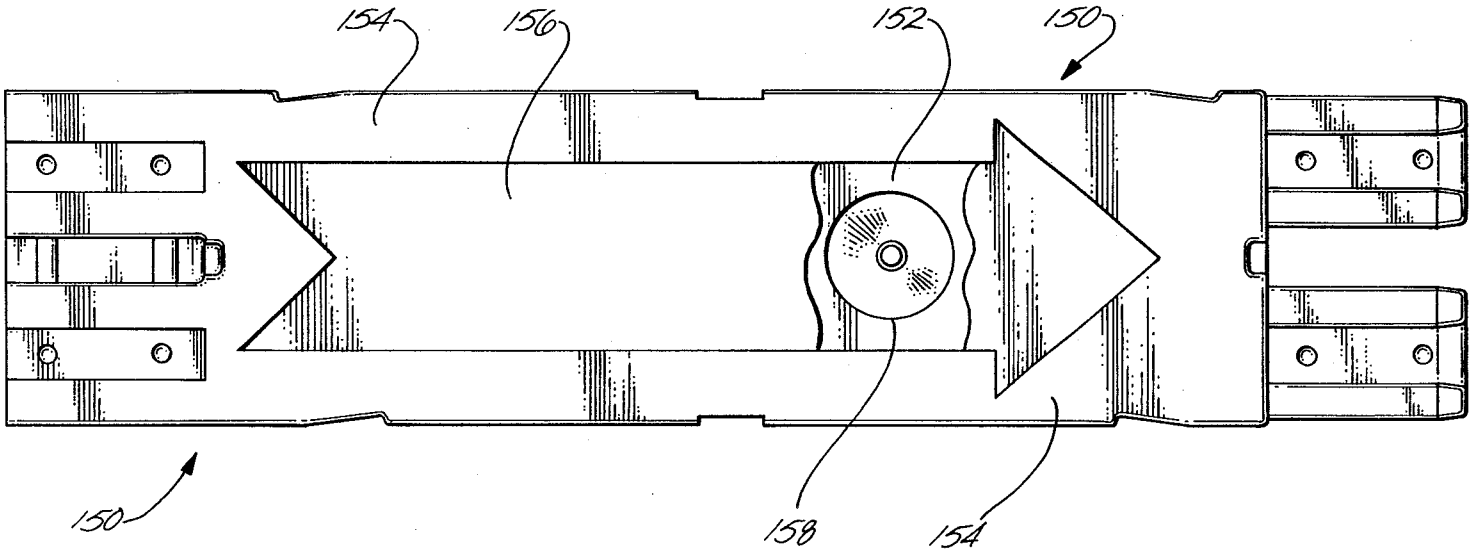
FIG. 8 is a side elevation view of another embodiment of a hollow crossbar section provided in accordance with this invention comprising an indentation in its surface in the form of an arrow with a light mounted therein.

Turning to FIG. 8, there is shown another embodiment of a hollow crossbar section 150 provided in accordance with practice of this invention. In this embodiment, a relatively-large indentation 152 in the shape of an arrow is formed in a first elongated side 154 of the section 150. The side opposite from the side 154 (not shown) is preferably flat and has no indentation. In a preferred embodiment, a clear plastic lens 156 covers the arrow 152, and a steady or flashing light 158 is mounted in the arrow under the clear plastic lens 156 to provide for illumination of the arrow.

The above descriptions of preferred embodiments of barricade devices provided in accordance with this invention are for illustrative purposes. Because of variations, which will be apparent to those skilled in the art, the present invention is not intended to be limited to the particular embodiments described above. The scope of the invention is defined in the following claims.

What is claimed is:

1. A barricade comprising:

(a) an elongated, hollow crossbar member comprising at least one elongated, inter-connecting hollow section interconnectable with other such elongated hollow sections and formed from plastic by a molding process, each such section having first and second elongated sides, first and second edges connecting the sides, and a generally rectangular cross-section transverse to its length, one end of each such section having at least one male extension and its opposite end having at least one female receptacle for receiving and securing the male extension of a mating section, and at least one identation in the first elongated side formed during the molding process, wherein such an indentation extends to the second elongated side such that an interior surface of the indentation on the first elongated side is fused to an interior surface of the second elongated side; and (b) a collapsible A-frame support for each end of the elongated, hollow crossbar member, each such collapsible A-frame support comprising a pair of hollow legs, with each leg having a bottom end for contact with the ground surface and a top end which includes a tang and notch, with the tang and notch on one leg facing in one direction and the tang and notch on the other leg facing in the opposite direction, the legs being pivotally connected together below their top ends, so that when the legs are fully opened, their top ends are engaged with the tang of each such leg engaging the notch of the other leg, thereby locking the top ends of the legs together to thereby define an opening configured to receive one end of the elongated, hollow crossbar member.

2. A barricade as is claimed in claim 1 wherein an opening is through the top ends of each leg, the openings configured to be in registration with each other when the top ends of the legs are locked together with the legs in their fully-open position.

3. A barricade as is claimed in claim 1 wherein at least one such indentation is in the form of an arrow, and means are provided to illuminate the arrow with either a steady or flashing light.

4. A barricade as is claimed in claim 1 wherein the opening defined by the engaged top ends of the legs is rectangular.

5. A barricade comprising:

(a) an elongated, hollow crossbar member comprising at least one elongated, inter-connecting hollow section interconnectable with other such elongated hollow sections and formed from plastic by a molding process, each such section having first and second elongated sides, first and second edges connecting the sides, and a generally rectangular cross-section transverse to its length, one end of each such section having at least one male extension and its opposite end having at least one female receptacle for receiving and securing the male extension of a mating section, and at least one indentation in the first elongated side formed during the molding process, wherein such an indentation extends to the second elongated side such that an interior surface of the indentation on the first elongated side is fused to an interior surface of the opposite elongated side, and wherein each such elongated crossbar section includes a pair of tapered grooves in at least one of the edges, spaced apart from each other along the length of the section, a first one of the grooves configured to mate with a bottom surface of the opening defined by an engaged leg top ends of a first A-frame support, and the second one of the grooves configured to mate with a bottom surface of an opening defined by engaged leg top ends of a second A-frame support.

6. A barricade package comprising:

(a) a plurality of hollow crossbar sections, each having first and second elongated sides, first and second edges connecting the sides, with a groove through each such edge, one end of each section having at least one male extension and its opposite end having at least one female receptacle configured to receive and secure the male extension of a mating section, so that when two or more such sections are joined together, they form an elongated, hollow crossbar member, the crossbar sections being stacked one on top of the other on their elongated sides, with the grooves in the edges lined up with each other;

(b) a pair of collapsible A-frame supports, each provided to mount one end of the elongated, hollow crossbar member when the barricade is erected, such a collapsible support comprising a pair of hollow legs, each having a bottom end for contact with the ground surface and one of the legs having a top end configured to engage a top end of the other leg, the legs pivotally connected together below their top ends so that when the legs are fully open, their top ends are engaged and define an opening configured to receive one end of the elongated, hollow crossbar member, the plurality of stacked together crossbar sections being sandwiched between one A-frame support under the crossbar section stack and the other A-frame support on top of the crossbar section stack, with the legs of the stacked A-frame supports in their closed condition extending along the length of the crossbar sections, each such leg having a slot through it in registration with the lined-up grooves in the crossbar section edges;

(c) a U-shaped locking bracket, with a base of the bracket extending below the A-frame support under the stack, the sides of the bracket extending through the slots in the legs of the bottom A-frame support, through the lined-up crossbar section grooves, and through the slots in the legs of the A-frame support on the top of the stack so that the tops of the bracket sides extend above the top A-frame support; and (d) means for latching together the top portions of the bracket sides so that the A-frame supports and crossbar sections are fastened together securely for transportation and storage.

7. A barricade package as is claimed in claim 6 wherein the hollow crossbar sections are formed from plastic in a molding process.

8. A barricade package as is claimed in claim 7 wherein each such crossbar section includes at least one indentation in the first elongated side formed during the molding process, such an indentation extending to the second elongated side such that an interior surface of the indentation on the first elongated side is fused to an interior surface of the second elongated side.

9. A barricade package as is claimed in claim 6 wherein the latching means comprises a rod formed into a loop having a bottom portion configured to extend through holes in the tops of the bracket sides and having a free end mounted in a hook formed in the end of the loop opposite the free end, the latching means acting as a handle by which the barricade package can be lifted.

* * * * *